US006837004B2

(12) United States Patent
Annes

(10) Patent No.: US 6,837,004 B2
(45) Date of Patent: Jan. 4, 2005

(54) CASEMENT LOCK KEEPER

(75) Inventor: Jason Annes, Chicago, IL (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 10/350,146

(22) Filed: Jan. 23, 2003

(65) Prior Publication Data

US 2004/0144033 A1 Jul. 29, 2004

(51) Int. Cl.[7] ..... E05B 65/06; E05F 11/02

(52) U.S. Cl. ..... 49/394; 49/279; 292/DIG. 33; 292/DIG. 20

(58) Field of Search ..... 49/394, 279, 395, 49/141; 292/DIG. 33, DIG. 20, DIG. 47

(56) References Cited

U.S. PATENT DOCUMENTS

| | | | | |
|---|---|---|---|---|
| 3,706,467 | A | | 12/1972 | Martin |
| 3,747,272 | A | | 7/1973 | Martin |
| 3,811,718 | A | | 5/1974 | Bates |
| 3,949,525 | A | | 4/1976 | Bates et al. |
| 4,241,541 | A | | 12/1980 | Van Klompenburg et al. |
| 4,253,276 | A | | 3/1981 | Peterson et al. |
| 4,346,372 | A | | 8/1982 | Sandberg |
| 4,860,493 | A | | 8/1989 | Lense |
| 4,907,832 | A | | 3/1990 | Pemberton |
| 4,937,976 | A | | 7/1990 | Tucker et al. |
| 4,973,091 | A | | 11/1990 | Paulson et al. |
| 4,991,886 | A | | 2/1991 | Nolte et al. |
| 5,045,265 | A | | 9/1991 | Pettit |
| 5,087,087 | A | | 2/1992 | Vetter et al. |
| 5,103,533 | A | | 4/1992 | Pettit et al. |
| 5,118,145 | A | | 6/1992 | Tucker |
| 5,152,103 | A | | 10/1992 | Tucker et al. |
| D347,569 | S | | 6/1994 | Vetter et al. |
| 5,414,899 | A | | 5/1995 | Raetz |
| 5,531,045 | A | | 7/1996 | Piltingsrud |
| 5,568,702 | A | | 10/1996 | Frank et al. |
| 5,568,703 | A | | 10/1996 | Frank et al. |
| 5,581,941 | A | | 12/1996 | Sill et al. |
| 5,581,942 | A | | 12/1996 | Sill et al. |
| RE35,463 | E | | 2/1997 | Vetter et al. |
| 5,603,538 | A | | 2/1997 | Evers |
| 5,615,522 | A | | 4/1997 | Tomanek |
| 5,741,031 | A | | 4/1998 | Bauman et al. |
| 5,813,171 | A | | 9/1998 | Piltingsrud |
| 5,813,710 | A | | 9/1998 | Anderson |
| 5,927,767 | A | * | 7/1999 | Smith et al. ..... 292/DIG. 33 |
| 6,139,070 | A | | 10/2000 | Piltingsrud |
| 6,367,853 | B1 | | 4/2002 | Briggs |
| 6,651,389 | B2 | * | 11/2003 | Minter et al. ..... 49/394 |

* cited by examiner

*Primary Examiner*—Hugh B. Thompson, II
(74) *Attorney, Agent, or Firm*—Wallenstein Wagner & Rockey, Ltd.

(57) ABSTRACT

A keeper (18) for use in a casement window assembly (10). The keeper (18) comprises a first portion (54), an intermediate portion (58), a second portion (56), and a slot (59). The first portion (54) has at least one aperture (60) adapted to receive a fastener. The first portion (54) also has a mounting surface (70) adapted to engage a portion of the casement window assembly (10). The intermediate portion (58) extends generally perpendicular from the first portion (54). The intermediate portion (58) has a rib (86) that increases the strength of the keeper (18) positioned adjacent an extent of the first portion (54). The second portion (56) extends from the intermediate portion (58) and has a finger (72) adapted to slidingly engage a pin (38) of the casement window assembly (10). The slot (59) is generally defined by the rib (86) and the finger (72) and is adapted to receive the pin (38) to secure the casement window assembly (10) in a locked position.

25 Claims, 3 Drawing Sheets

CASEMENT LOCK KEEPER

CROSS-REFERENCE TO RELATED APPLICATIONS

Not Applicable.

FEDERALLY SPONSORED RESEARCH OR DEVELOPMENT

Not Applicable.

TECHNICAL FIELD

The present invention relates to a keeper for a casement window assembly. More specifically, the present invention relates to a keeper having a unique structure that improves the overall strength and rigidity of the keeper.

BACKGROUND OF THE INVENTION

Casement window assemblies are well-known within the window industry. Generally, the casement window assembly includes a rectangular frame assembly and a window assembly. The frame assembly supports the window assembly when the window assembly is in either a closed position or an open position. The window assembly includes a glass pane supported by a plurality of frame members. The frame assembly includes a plurality of frame members and a lock assembly. The lock assembly includes a keeper and related hardware, including a pin, a handle, and a rotary device. The keeper is generally mounted to one of the frame members of the window assembly. Typically, the pin is affixed to an interior portion of one frame member and coupled to the handle. The pin engages the keeper when the window assembly is in the closed or nearly-closed position. The rotary device permits a user to move the window assembly between opened and closed positions.

In conventional window assemblies, the keeper is cooperatively positioned with the pin such that the keeper receives the pin when the user actuates the handle. Prior to actuating the handle, the user rotates the rotary device to move the window assembly from the open position to the closed position. Similarly, the keeper disengages the pin when the user actuates the handle and rotates the handle to move the window assembly from the closed position to the open position. The engagement between the keeper and the pin is essential to secure the window assembly in the closed position.

In the window industry, a number of tests are utilized to evaluate the strength of the casement window assembly, including the keeper. One such test evaluates the strength of the keeper by applying a progressive amount of force to the keeper until it fails. A keeper fails the test when it deforms such that it can no longer engage the pin and, as a result, no longer secure the window assembly. Conventional keepers can withstand approximately 250 pounds of force or loading.

In another type of test, commonly referred to as an impact/cycle test, a projectile impacts the window assembly in two spots. The window assembly is then pressure-cycled to ensure that it does not open in a simulated hurricane. To meet this strength standard, manufacturers of casement window assemblies typically utilize a plurality of conventional keepers, often more than three sets of keepers and pins per casement window assembly. This significantly increases the cost of the window hardware and as a result, the cost of the casement window assembly.

Consequently, there is a need for a keeper having increased strength such that less hardware is necessary for the casement window assembly to meet the industry standards for strength. The present invention is provided to solve these and other deficiencies.

SUMMARY OF THE INVENTION

The present invention relates to a keeper for use in a casement window assembly, which includes a frame assembly and a window assembly. The window assembly includes a glass pane supported by a plurality of frame members. The keeper is mounted to one of the frame members of the window assembly. The frame assembly includes a plurality of frame members. The frame assembly includes a rotary device adapted to move the window assembly between an open position and a closed position. The casement window assembly further has a lock assembly. The lock assembly includes the keeper, a pin, and a retainer. The pin extends from a lock bar, which is slidably mounted by the retainer to an interior portion of one frame member. The pin is adapted to engage the keeper when the window assembly is in the closed or nearly-closed position.

The keeper has a first portion, a second portion, an intermediate portion, and a slot or recess. The first portion of the keeper has a first aperture and a second aperture, wherein each aperture is adapted to receive a fastener to secure the keeper to the window frame member. The first portion has a rounded upper segment, an intermediate segment, and a rounded lower segment. Also, the first portion has a mounting surface that contacts a portion of the window frame member when the keeper is affixed to the frame member.

The second portion of the keeper has an elongated finger extending from an upper segment of the second portion. The finger is adapted to slidingly engage a portion of the pin when the window assembly is moved from the closed position to the open position, or from the open position to the closed position. The second portion has an interior edge that abuts the intermediate portion. The keeper is preferably configured such that the second portion is oriented generally perpendicular to the first portion.

The intermediate portion of the keeper is positioned between the interior edge of the first portion and the interior edge of the second portion. Unlike conventional devices, a rib extends from an upper segment of the intermediate portion. The rib is an elongated structure that increases the structural integrity or strength of the keeper. The rib is positioned adjacent to the interior edge of the first portion. In addition, the rib is generally aligned with the intermediate segment of the first portion. When viewed in cross-section, the contact between the rib and the first portion defines an "L-shaped" structure. The rib has a sloped or tapered configuration, meaning that its top and bottom segments do not share the same geometry. The keeper is preferably configured such that the intermediate portion is oriented generally perpendicular to the first portion.

The slot is generally positioned between the finger of the second portion and the rib of the intermediate portion. The slot is adapted to slidingly engage a portion of the pin when the window assembly is moved from the closed position to the open position, or from the open position to the closed position. The slot has a pair of interior edges and an apex portion.

Conventional keeper designs lack the rib of the present invention. Since the rib is positioned along or makes contact with an extent of the first portion, the rib dramatically increases the strength of the keeper. In addition, the rib alters the configuration of the keeper.

Other features and advantages of the invention will be apparent from the following specification taken in conjunction with the following drawings.

DETAILED DESCRIPTION OF THE INVENTION

Figure 1:
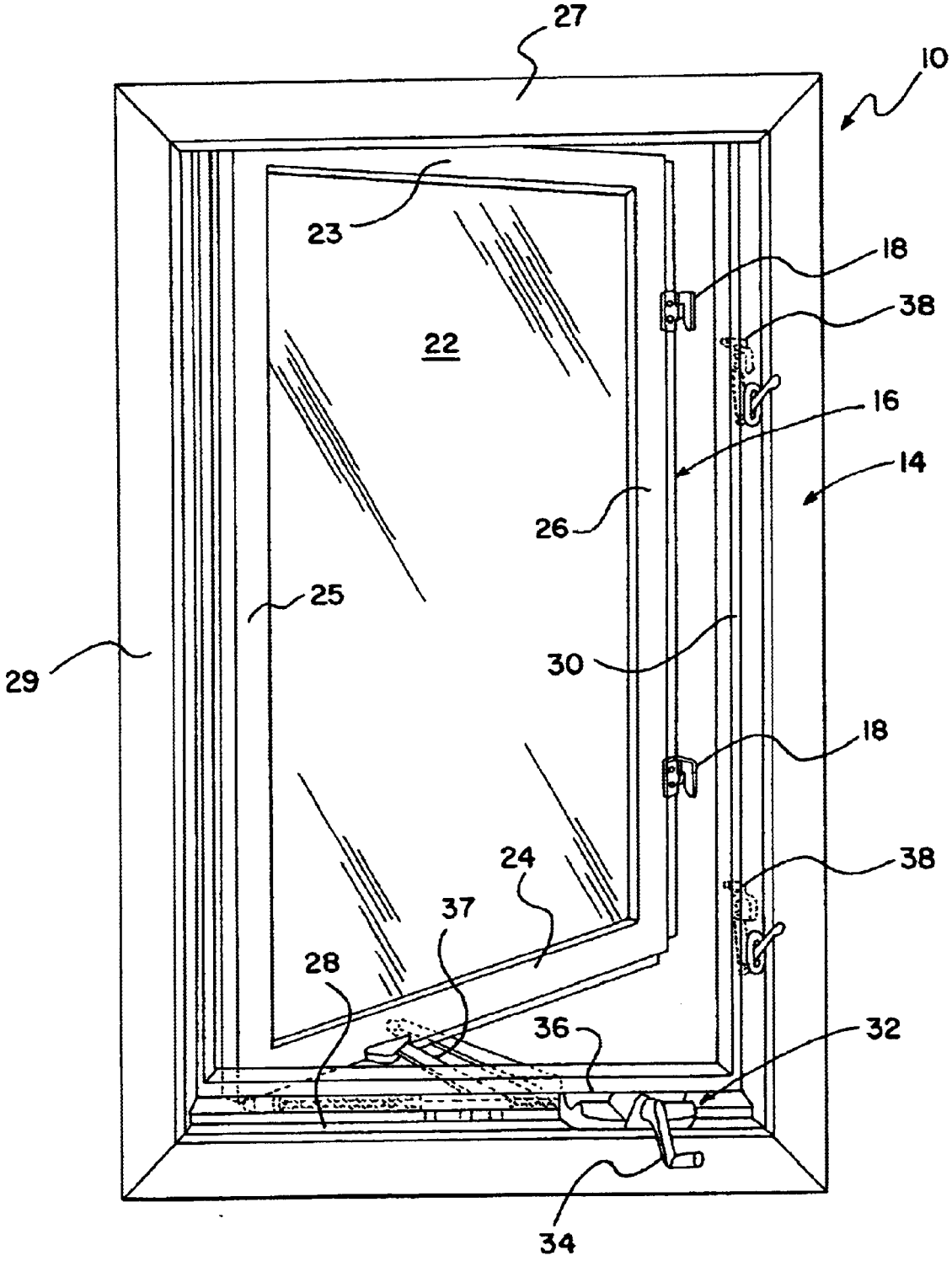
FIG. 1 is a perspective view of a casement window assembly having a keeper of the present invention and showing a window assembly in an open position.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 depicts a casement window assembly 10 which includes a frame assembly 14 and a window assembly 16. A pair of keepers 18 are shown mounted to the window assembly 16. The window assembly 16 includes a glass pane 22 that is supported by a top window frame member 23, a bottom window frame member 24, a left window frame member 25, and a right window frame member 26. Although two keepers 18 are shown, the number of keepers 18 varies with the design parameters of the casement assembly 10 including the size and configuration of the frame and window assemblies 14, 16. It is understood that the window assembly 16 can be configured to open from either side of the frame assembly 14.

The frame assembly 14 includes atop horizontal frame member 27, a bottom horizontal frame member or sill 28, a left vertical frame member or left jamb 29, and a right vertical frame member or right jamb 30. The frame assembly 14 further includes a rotary device or actuator 32 with a handle 34 extending from a base 36. The rotary device 32 also includes a pair of links 37 coupled to the handle 34. The rotary device 32 is adapted to move the window assembly 16 in the frame assembly 14 between an open position and a closed position.

Figure 2:
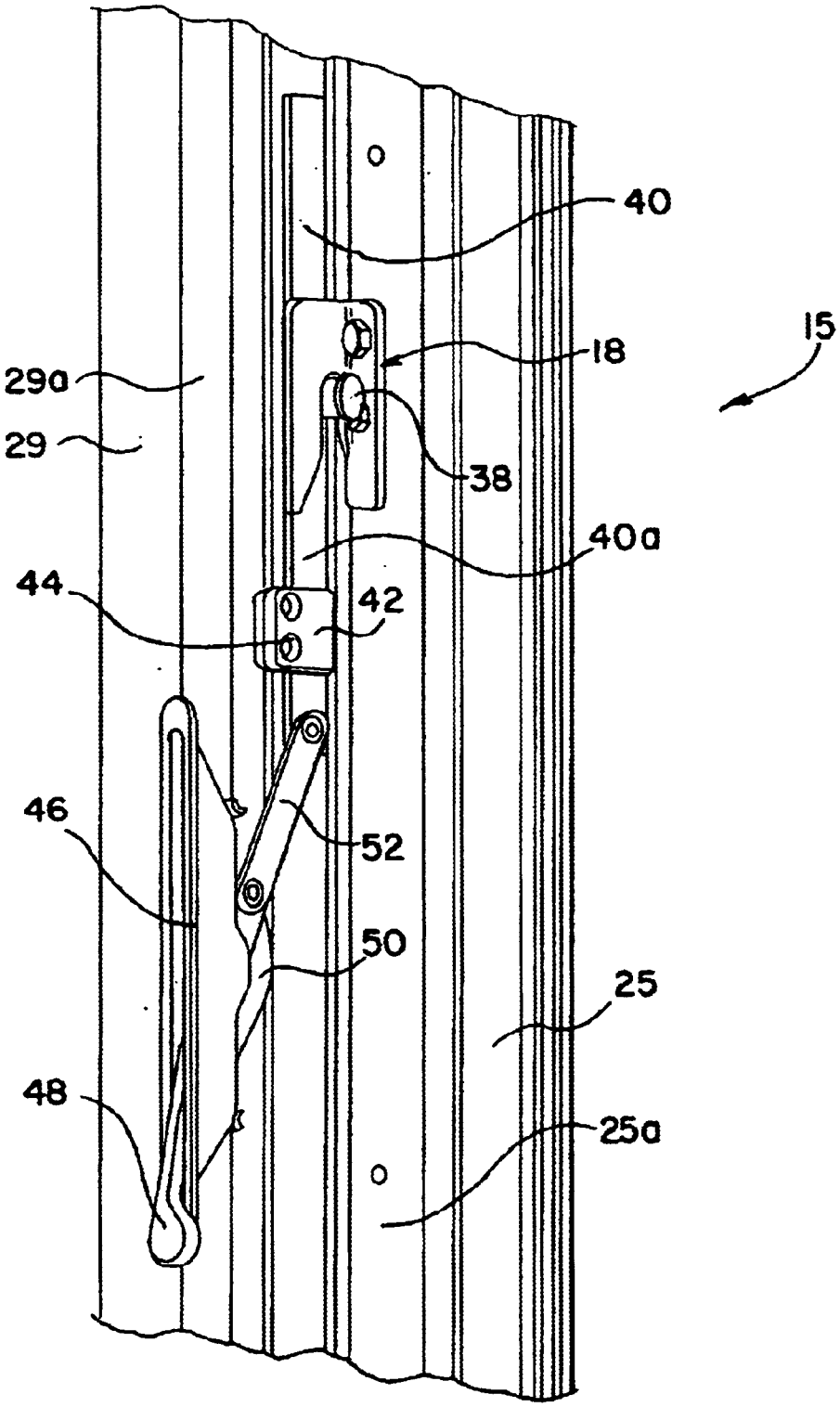
FIG. 2 is a partial perspective view of the casement assembly of FIG. 1 showing the keeper and related hardware of the casement assembly.

Referring to FIG. 2, the casement window assembly 10 further includes a lock assembly 15. Whereas FIG. 1 shows a window assembly that opens left, FIG. 2 shows a window assembly that opens right. The lock assembly 15 generally comprises the keeper 18, an engaging member or pin 38, a lock bar 40, and a retainer 42. As shown in FIG. 2, the keeper 18 is affixed to an interior portion 25*a* of the left window frame member 25. The pin 38 is adapted to engage the keeper 18 when the window assembly 16 is in a closed or nearly-closed position. The pin 38 extends substantially perpendicular from the lock bar 40, which is slidably mounted to an interior portion 29*a* of the left vertical frame member 29. The pin 38 can be fastened to the lock bar 40, or it can be integrally formed with the lock bar 40. The lock bar 40 is slidably mounted to the frame member 29 by at least one retainer 42. A second retainer (not shown) can be positioned above the pin 38 to provide additional slidable support to the lock bar 40. The number of retainers 42 varies with the design parameters of the window assembly 10, including the size and configuration of the lock bar 40, the pin 38, and the keeper 18. The retainer 42 has a plurality of apertures 44 adapted to receive a fastener that affixes the retainer 42 to the frame member 29. The retainer 42 also has a channel (not shown) adapted to receive a portion of the lock bar 40. The channel of the retainer 42 receives a lower portion 40*a* of the lock bar 40 and provides slidable support to the lock bar 40 in a substantially vertical direction. The lock assembly 15 further includes a bezel 46 and a handle 48 positioned on the left frame member 29. The bezel 46 and the handle 48 are coupled to the lock bar 40 at its lower portion 40*a* by a link 50 and a tenon 52. The bezel 46 is adapted to be flush mounted in the frame member 29 with the handle 48 extending therefrom.

Referring to FIG. 1, the window assembly 16 is in the open position. To place the casement window assembly 10 in the closed position, the user rotates the rotary device 32 to position the window assembly 16 substantially proximate the frame assembly 14. To place the casement window assembly 10 in a locked position, the user actuates the handle 48 an initial amount whereby the lock bar 40 and the pin 38 are vertically displaced towards the keeper 18. The user continues to actuate the handle 48 in a generally downward direction until the pin 38 engages or is received by the keeper 18. The engagement between the keeper and the pin is essential to secure the window assembly in the locked position. It follows that the keeper 18 is secured to the right window frame member 26 a distance above the bottom sill 28 such that the keeper 18 can receive the pin 38 when the handle 48 is actuated. To place the casement window assembly 10 in the open position, the user actuates the handle 48 in a generally upward direction such that the lock bar 40 and the pin 38 move downward and whereby the pin 38 disengages the keeper 18. Once the keeper 18 and the pin 38 are no longer engaged, the user rotates handle 34 of the rotary device 32 to move the window assembly 16 to the open position.

Figure 3:
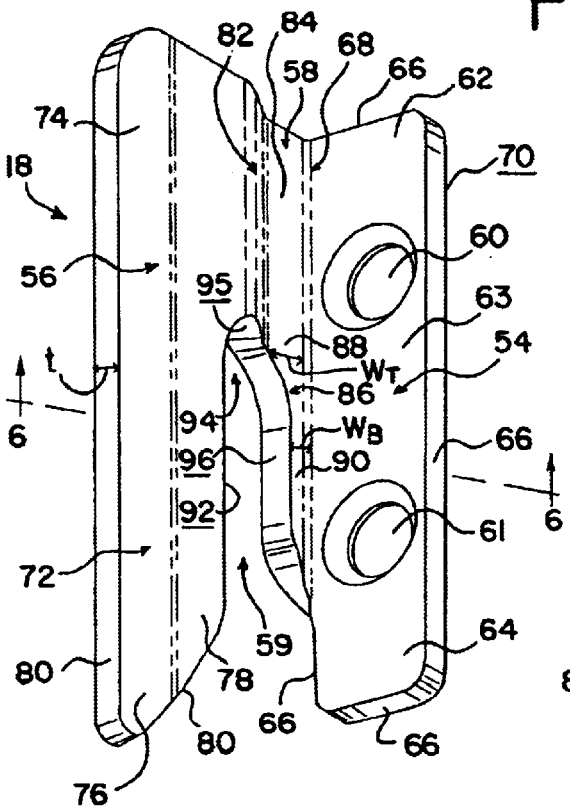
FIG. 3 is a perspective view of the keeper of FIG. 1.

As shown in FIG. 3, the keeper 18 generally has a first portion 54, a second portion 56, an intermediate portion 58, and a slot or recess 59. The keeper 18 has a thickness *t*, which can vary with the design parameters of the casement assembly 18 including the pin 38. The first portion 54 of the keeper 18 has a first aperture 60 and a second aperture 61, each adapted to receive a fastener to secure the keeper 18 to the window frame member 25 (see FIG. 2). The number and size of apertures can vary with the design parameters of the keeper 18. The first portion 54 has a rounded upper segment 62, an intermediate segment 63, and a rounded lower segment 64. In addition, the first portion 54 has an exterior edge 66. The first portion 54 also has an interior edge 68 that abuts the intermediate portion 58. The first portion 54 has a mounting surface 70 that contacts a portion of the window frame member 25 when the keeper 18 is affixed to the frame member 25. Preferably, the first portion 54 of the keeper 18 has a generally rectangular configuration.

The second portion 56 of the keeper 18 has an elongated finger 72 extending from an upper segment 74 of the second portion 56. The finger 72 has a tip segment 76, a nose segment 78, and an exterior edge 80. The finger 72 is adapted to slidingly engage a portion of the pin 38 when the window assembly 16 is moved from the closed position to the open position, or from the open position to the closed position. The second portion 56 has an interior edge 82 that abuts the intermediate portion 58. Preferably, the length of the second portion 56 is greater than the length of the first portion 54 and the intermediate portion 58 (see FIG. 4). The keeper 18 is preferably configured such that the second portion 56 is oriented generally perpendicular to the first portion 54.

Figure 4:
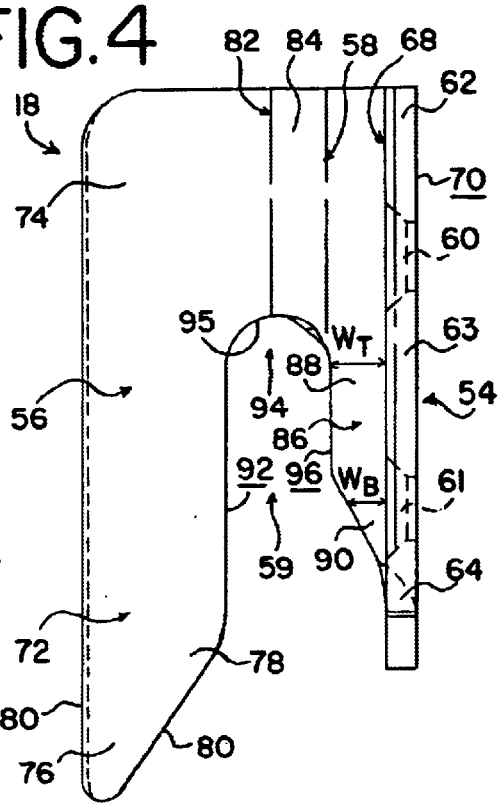
FIG. 4 is a plan view of the keeper of FIG. 1.
Figure 6:
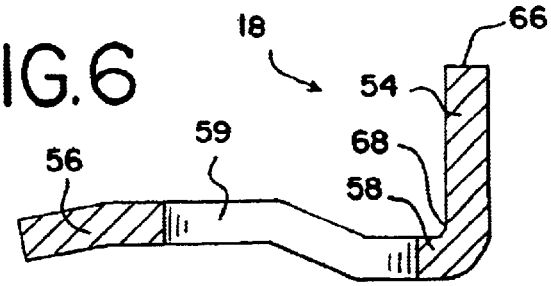
FIG. 6 is a cross-sectional view of the keeper of FIG. 1 taken along line 6—6 of FIG. 3.

The intermediate portion 58 is positioned between the interior edge 68 of the first portion 54 and the interior edge 82 of the second portion 56. The intermediate portion 58 has an upper segment 84. Unlike conventional devices, a rib 86 extends from the upper segment 84. The rib 86 is an elongated structure that increases the structural integrity or strength of the keeper 18. Referring to FIGS. 3 and 4, the rib 86 is positioned adjacent to the interior edge 68 of the first portion 54. Described in a different manner, the rib 86 abuts an extent of the interior edge 68. As shown in the cross-sectional view of FIG. 6, the contact between the rib 86 and the first portion 54 defines an "L-shaped" structure. The rib 86 has a top segment 88 and bottom segment 90. Preferably, the rib 86 is generally aligned with the intermediate segment 63 of the first portion 54. This means that the top segment 88 is positioned substantially between the first aperture 60 and the second aperture 61. Alternatively, the top segment 88 of the rib 86 is aligned with either the first aperture 60 or the top segment 62 of the first portion 54. The bottom segment 90 of the rib 86 is substantially aligned with the second aperture 61. Alternatively, the bottom segment 90 extends past the second aperture 61. As shown in FIGS. 3 and 4, the rib 86 has a sloped or tapered configuration, meaning that the top and bottom segments 88, 90 do not share the same geometry. However, the top and bottom segments 88, 90 can be designed to have the same geometry thereby causing the rib 86 to have a linear configuration. Preferably, the length of the intermediate portion 58 is less than the length of the first portion 54 and the second portion 56 (see FIG. 4). The keeper 18 is preferably configured such that the intermediate portion 58 is oriented generally perpendicular to the first portion 54.

The slot 59 is generally positioned between the finger 72 of the second portion 56 and the rib 86 of the intermediate portion 58. In other words, the configuration of the slot 59 is generally defined by the finger 72 and the rib 86. The slot 59 is adapted to slidingly engage a portion of the pin 38 when the window assembly 16 is moved from the closed position to the open position, or from the open position to the closed position. Described in different terms, the slot 59 is adapted to receive a portion of the pin 38 when the window assembly 16 is moved from the closed position to the open position, or from the open position to the closed position. The slot 59 has a first interior surface 92 corresponding to, or defined by the finger 72. The slot 59 also has a second interior surface 96 corresponding to, or defined by the rib 86. Due to the presence of the rib 86, the first interior surface 92 is generally opposed to the second interior surface 96. Described in a different manner, the first interior surface 92 is generally opposed to the second interior surface 96. An apex or top portion 94 of the slot 59 is defined by the combination of the rib 86, the intermediate portion 58, and the finger 56. The apex portion 94 has an apex surface 95 (see FIG. 4). The apex surface 95 is sloped or swaged to increase the strength of the keeper 18 through a variety of methods, including but not limited to work hardening. Although the apex portion 94 is shown as having a generally curvilinear configuration, it can have a generally linear configuration. The slot 59 has a "U-shaped" configuration, however, the precise configuration can vary with the design of the keeper 18 and the pin 38.

It is understood that the intermediate portion 58 can be considered to be integral with or a part of the second portion 56. As a result, the second portion 56 extends generally perpendicular from the interior edge 68 of the first portion 54 and wherein the rib 86 is adjacent the first portion 54. In this manner, the slot 59 is positioned within the second portion 56 and the slot 59 is generally defined by the rib 86 and the finger 72 of the second portion 56.

Figure 5:
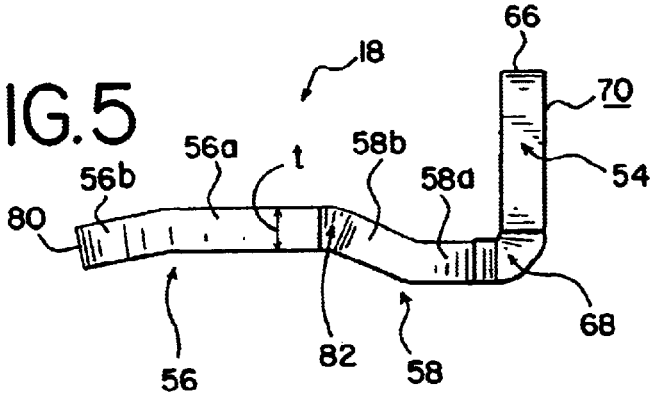
FIG. 5 is an end view of the keeper of FIG. 1.

Referring to FIG. 5, the keeper 18 has a complex configuration. As shown therein, the first portion 54 defines the generally planar mounting surface 70. The interior edge 68 has a generally rounded configuration. The intermediate portion 58 has a first region 58*a* and a second region 58*b*, wherein the first region 58*a* extends from the interior edge 68. The second region 58*b* extends from the first region 58*a* such that the intermediate portion 58 has an angled configuration when viewed from an end of the keeper 18. The interior edge 82 is positioned between the intermediate portion 58 and the second portion 56. The second portion 56 has a first region 56*a* and a second region 56*b*, wherein the first region 56*a* extends from the interior edge 82. The second region 56*b* extends from the first region 56*b* such that the second portion 56 has an angled configuration when viewed from an end of the keeper 18.

Conventional keeper designs lack the rib 86 of the present invention. Although most conventional designs include a slot to receive a pin, the interior edge of the slot is omitted such that the slot makes direct contact with the first portion. As a result, the first portion defines the configuration of the slot—namely an interior edge of the slot. In contrast, the rib 86 makes contact with an extent of the first portion 54 and defines the interior edge 96 of the slot 59. Thus, the rib 86 dramatically alters the configuration of the keeper 18. In addition, a multitude of conventional keepers feature a relief, meaning a portion of material from the first portion is removed from the keeper. The relief is intended to increase the strength of the conventional keeper. The keeper 18 of the present invention does not require this feature, since the rib 86 increases the strength of the keeper 18. In addition, forming the relief increases the manufacturing costs of the conventional keeper.

As explained above, the rib 86 is adapted to increase the structural integrity or strength of the keeper 18. Applying industry-wide testing, this means the keeper 18 can be subjected to a greater amount of force than conventional devices before deforming and/or reaching a failure point. During testing, this force is typically applied to a region of the second portion 56 in a direction substantially perpendicular to the first portion 54 tending to force the second portion 56 away from the first portion 54. The rib 86 increases the rigidity of the keeper 18 thereby increasing the overall strength of the keeper 18. In a preferred embodiment, the keeper 18 of the present invention can withstand over 500 pounds of force loading before failure, whereas conventional keepers fail at approximately 250 pounds of force loading. As a result and compared to conventional designs, a lesser number of keepers 18 for a casement window assembly 10 are required to meet the industry standards used to evaluate the overall strength of the casement window assembly 10. This increases the utility and value of the keeper 18 and reduces the overall hardware costs of the casement window assembly 10.

The keeper 18 can be fabricated from a variety of materials, including metal. For example in a preferred embodiment, the keeper 18 can be fabricated from 304 stainless steel. The remaining components of the casement window assembly 10, such as the pin 38, the lock bar 40, and the link 50 can be formed from a number of materials. The length of the keeper 18 can vary between 1.0–4.0 inches depending upon the design parameters of the keeper 18 and the casement window assembly 10.

While the specific embodiments have been illustrated and described, numerous modifications come to mind without significantly departing from the spirit of the invention and the scope of protection is only limited by the scope of the accompanying Claims.

I claim:

1. A keeper for use in a casement window assembly, the keeper comprising:

a first portion having at least one aperture adapted to receive a fastener, the first portion further having a mounting surface adapted to engage a portion of the casement window assembly;

an intermediate portion extending generally perpendicular from the first portion. the intermediate portion having a rib extending therefrom and positioned adjacent to an extent of the first portion;

a second portion extending from the intermediate portion, the second portion having a finger adapted to slidingly engage a pin of the casement window assembly; and, a slot generally positioned between the rib of the intermediate portion and the finger of the second portion, the slot adapted to receive the pin of the casement window assembly.

2. The keeper of claim 1 wherein a first interior edge of the slot is defined by the finger.

3. The keeper of claim 2 wherein a second interior edge of the slot Is defined by the rib.

4. The keeper of claim 3 wherein an apex portion of the slot is defined by the combination of the finger, the intermediate portion, and the rib.

5. The keeper of claim 1 wherein the intermediate portion extends from an interior edge of the first portion.

6. The keeper of claim 1 wherein the intermediate portion has a width and wherein the rib has a width, the width of the intermediate portion being greater than the width of the rib.

7. The keeper of claim 1 wherein the rib has a top segment and a bottom segment, the top segment having a width greater than a width of the bottom segment.

8. The keeper of claim 1 wherein the rib has a top segment and a bottom segment, the rib having a sloped configuration between the top and bottom segments.

9. The keeper of claim 1 wherein the keeper Is fabricated from steel.

10. A keeper for use in a casement window assembly, the keeper comprising:

a first portion having a first aperture and a second aperture, the first portion having a mounting surface adapted to engage a portion of the window assembly; and, a second portion extending from an interior edge of the first portion, the second portion having a rib extending therefrom and positioned along the interior edge of the first portion, the second portion having a finger adapted to slidingly engage a pin of the window assembly.

11. The keeper of claim 10 wherein the finger and the rib define a slot adapted to receive the pin of the window assembly.

12. The keeper of claim 10 wherein the second portion has an upper segment, the rib extending from the upper segment.

13. The keeper of claim 12 wherein the finger extends from the upper segment of the second portion.

14. The keeper of claim 13 wherein the rib has a top segment and a bottom segment, the top segment having a width greater than a width of the bottom segment.

15. The keeper of claim 14 wherein the second portion is integral to the first portion.

16. The keeper of claim 10 wherein the rib is positioned generally between the first and second apertures.

17. The keeper of claim 10 wherein the rib has a top segment and a bottom segment, the top segment being positioned between the first and second apertures and the bottom segment being generally aligned with the second aperture.

18. A casement window assembly comprising:

a frame assembly having a plurality of frame members, the frame assembly further having a pin affixed to a frame member;

a window assembly operably connected to the frame assembly, the window assembly having a glass pane supported by a plurality of window frame members, the window assembly further having a keeper affixed to a window frame member, the keeper having a first portion and a second portion extending from an interior edge of the first portion, the second portion having a rib extending therefrom and positioned along the interior edge of the first portion, the second portion further having a finger adapted to slidingly engage the pin of the frame assembly.

19. The casement window assembly of claim 18 wherein the finger and the rib define a slot adapted to receive the pin affixed of the frame assembly.

20. The casement window assembly of claim 19 wherein the keeper is cooperatively positioned with the pin whereby the pin engages the slot of the keeper when the window assembly is in a closed position.

21. The casement window assembly of claim 18 wherein the pin extends substantially perpendicular to the frame member of the frame assembly.

22. The casement window assembly of claim 18 wherein the keeper extends substantially perpendicular to the frame member of the window assembly.

23. A keeper for use in a casement window assembly, the keeper comprising:

a first portion having a first aperture and a second aperture, the first portion having a mounting surface adapted to engage a portion of the window assembly; and, a second portion extending from an interior edge of the first portion, the second portion having a rib extending along the interior edge of the first portion, the second portion having a finger adapted to slidingly engage a pin of the window assembly, wherein the rib has a top segment and a bottom segment, the top segment having a width greater than a width of the bottom segment.

24. A keeper for use in a casement window assembly, the keeper comprising:

a first portion having at least one aperture adapted to receive a fastener, the first portion further having a mounting surface to engage with a portion of the casement window assembly;

an intermediate portion extending generally perpendicular from the first portion, the intermediate portion having a rib extending along a major extent of the first portion; and, a second portion extending from the intermediate portion, the second portion having a finger adapted to slidingly engage a pin of the casement window assembly.

25. A keeper for use in a casement window assembly, the keeper comprising:

a first portion having at least one aperture adapted to receive a fastener;

a rib extending generally perpendicular from the first portion, the rib residing in a first plane;

an intermediate portion extending transversely from the rib; and, a second portion extending from the intermediate portion, the second portion residing in a second plane that is misaligned with the first plane of the rib, the second a portion having a finger that is adapted to slidingly engage a pin of the casement window assembly.

* * * * *